US005175559A

United States Patent [19]

Schrank et al.

[11] Patent Number: 5,175,559

[45] Date of Patent: Dec. 29, 1992

[54] COMBINED RADAR/ESM ANTENNA SYSTEM AND METHOD

[75] Inventors: Helmut E. Schrank, Cockeysville; Philip S. Hacker, Silver Spring, both of Md.

[73] Assignee: Westinghouse Electric Corp., Pittsburgh, Pa.

[21] Appl. No.: 782,189

[22] Filed: Oct. 24, 1991

[51] Int. Cl.[5] ..... H01Q 19/00

[52] U.S. Cl. ..... 343/756; 343/708

[58] Field of Search ..... 343/756, 705, 708, 781, 343/837

[56] References Cited

U.S. PATENT DOCUMENTS 3,271,771 9/1966 Hannan et al. ..... 343/756
3,281,850 10/1966 Hannan ..... 343/756
3,403,394 9/1968 Rouault ..... 343/756
3,413,637 11/1968 Goebels, Jr. et al. ..... 343/756
3,708,795 1/1973 Lyons ..... 343/756

*Primary Examiner*—Rolf Hille
*Assistant Examiner*—Hoanganh Le
*Attorney, Agent, or Firm*—T. H. Martin

[57] ABSTRACT

A combined antenna system mounted in a nose randome of an aircraft for both radar and ESM signals. A flat plate waveguide antenna, a twist panel, a selective reflector, and a feed are aligned along a longitudinal axis in the randome. The polarized electromagnetic energy is twisted 45 degrees; and the selective reflector passes the twisted electromagnetic energy and reflects energy polarized in planes substantially different than the twisted plane.

20 Claims, 4 Drawing Sheets

COMBINED RADAR/ESM ANTENNA SYSTEM AND METHOD

BACKGROUND OF THE INVENTION

Field of Invention

The present invention relates to an antenna; and more particularly to a combined Radar/ESM antenna system and related method.

An electronic support measures (ESM) system involves receiving and analyzing radiated electromagnetic energy transmitted by a remote transmitter for determining the characteristics and source of the energy. For example, a conventional ESM receiver may process received radar pulses to identify the center frequency, amplitude, pulse width, and time of arrival. For some applications, such received electromagnetic energy, together with the relative bearing of the transmitter is merely displayed in the cockpit of the aircraft. In other applications, the received energy is used to control the transmission of electronic countermeasure signals (ECM).

It is desirable for an aircraft not only to have a radar system for detecting threats or targets; but also, to be equipped with ESM for detecting signals emanating from such threats. For aircraft having both such systems, it is necessary that the return energy from the aircrafts own system is distinguished from signals generated by other transmitters. In order to meet this requirement, it is necessary to use a different antenna for each system. This can be accomplished with relative ease in airborne systems mounted on large aircraft. However, in small aircraft that utilize a radome mounted antenna, there is little remaining space in the radome for mounting an additional antenna.

SUMMARY OF INVENTION

It is an object of the present invention to provide an antenna system and method for transmitting radar signals and receiving return signals therefrom, as well as receiving transmitted ESM signals from a remote system, that makes maximum use of the aperture of the radome in a small aircraft.

Another object of the present invention is to provide an antenna system and method for receiving and discriminating between ESM signals and return radar signals arriving from a similar direction.

Additional objects and advantages of the invention will be set forth in part in the description which follows, and in part will be obvious from the description, or may be learned by practice of the invention. The objects and advantages of the invention may be realized and obtained by means of the instrumentalities and combinations particularly pointed out in the appended claims.

To achieve the objects, and in accordance with the purpose of the invention, as embodied and broadly described herein, the combined Radar/ESM antenna system comprises a waveguide antenna having an axis and a radiating and receiving front surface extending in a plane orthogonal to the axis for radiating and receiving RF energy polarized in a predetermined plane; means disposed along the axis opposing the front surface of the waveguide antenna for twisting the polarized energy radiated from the front surface about the axis a selected number of degrees from the predetermined plane and for twisting the twisted return energy about the axis in the opposite direction a selected number of degrees to the predetermined plane; discriminating means disposed along the axis adjacent the twisting means for passing in opposite directions along the axis the polarized energy twisted about the axis the selected number of degrees from the predetermined plane and for reflecting received energy polarized in planes substantially different from said twisted plane; and feed means disposed along the axis opposing the discriminating means for collecting the reflected energy.

In another aspect, to achieve the objects and in accordance with the purpose of the invention, as embodied and broadly described herein, the method of radiating electromagnetic energy and receiving return energy in combination with receiving ESM signals along the same antenna axis, comprises radiating and receiving electromagnetic energy polarized in a predetermined plane at an antenna surface along an axis; twisting the radiated and return energy about the axis approximately forty-five degrees from the predetermined plane; passing the twisted radiated and return electromagnetic energy in opposite directions along the axis through a selective reflector; reflecting electromagnetic energy received along the axis polarized in planes substantially different from the twisted plane; and collecting the polarized reflected electromagnetic energy.

The accompanying drawings, which are incorporated in and constitute a part of this specification, illustrate one embodiment of the invention, and together with the description serve to explain the principles of the invention.

DESCRIPTION OF THE PREFERRED EMBODIMENT

Figure 2:
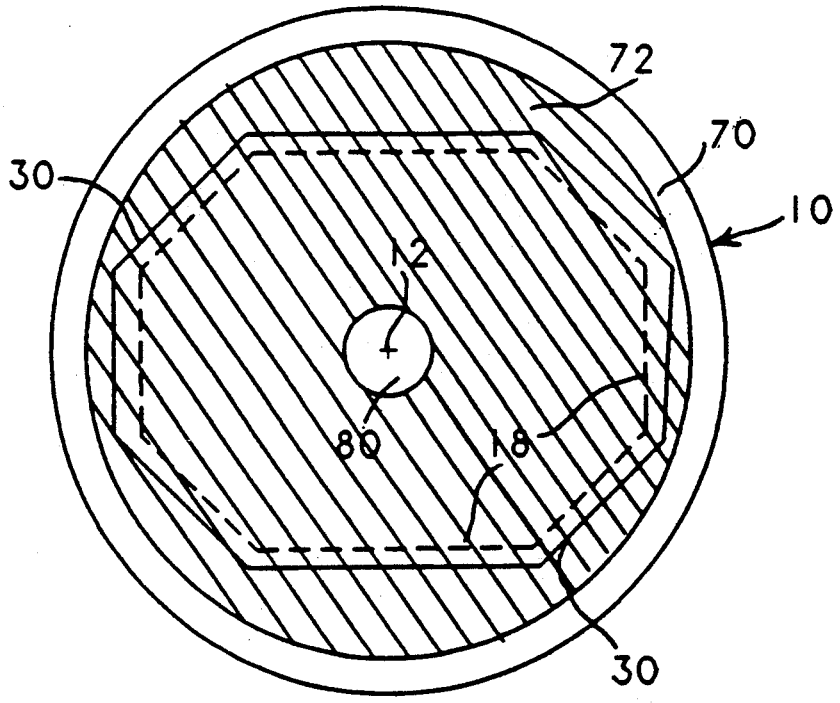
FIG. 2 is a front head on view of an antenna system in accordance with the present invention.
Figure 1:
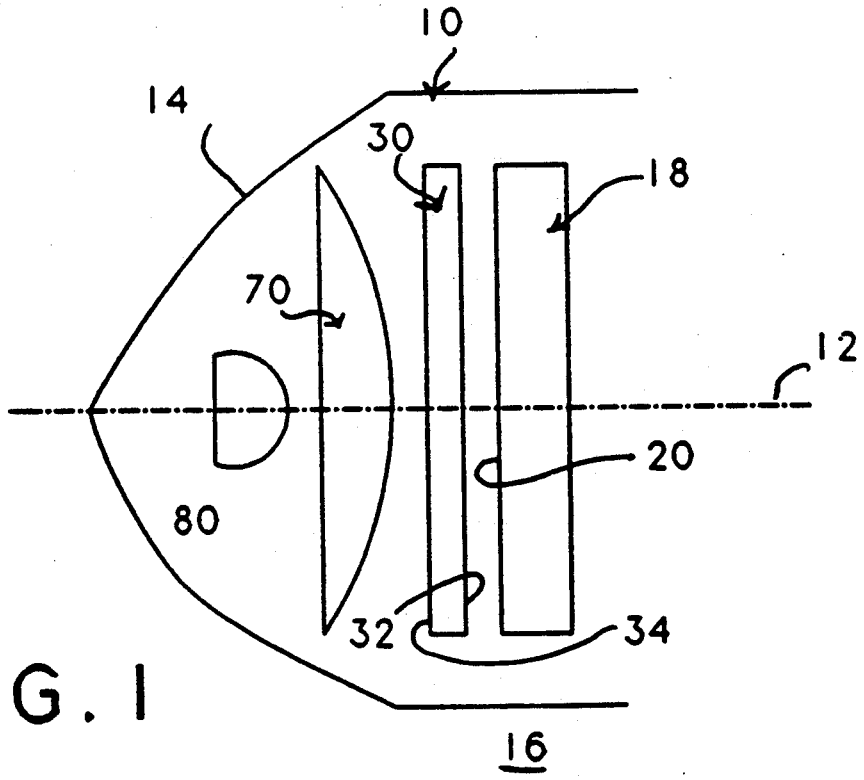
FIG. 1 is a profile of the antenna system schematically illustrating the system in a radome of an aircraft.
Figure 3:
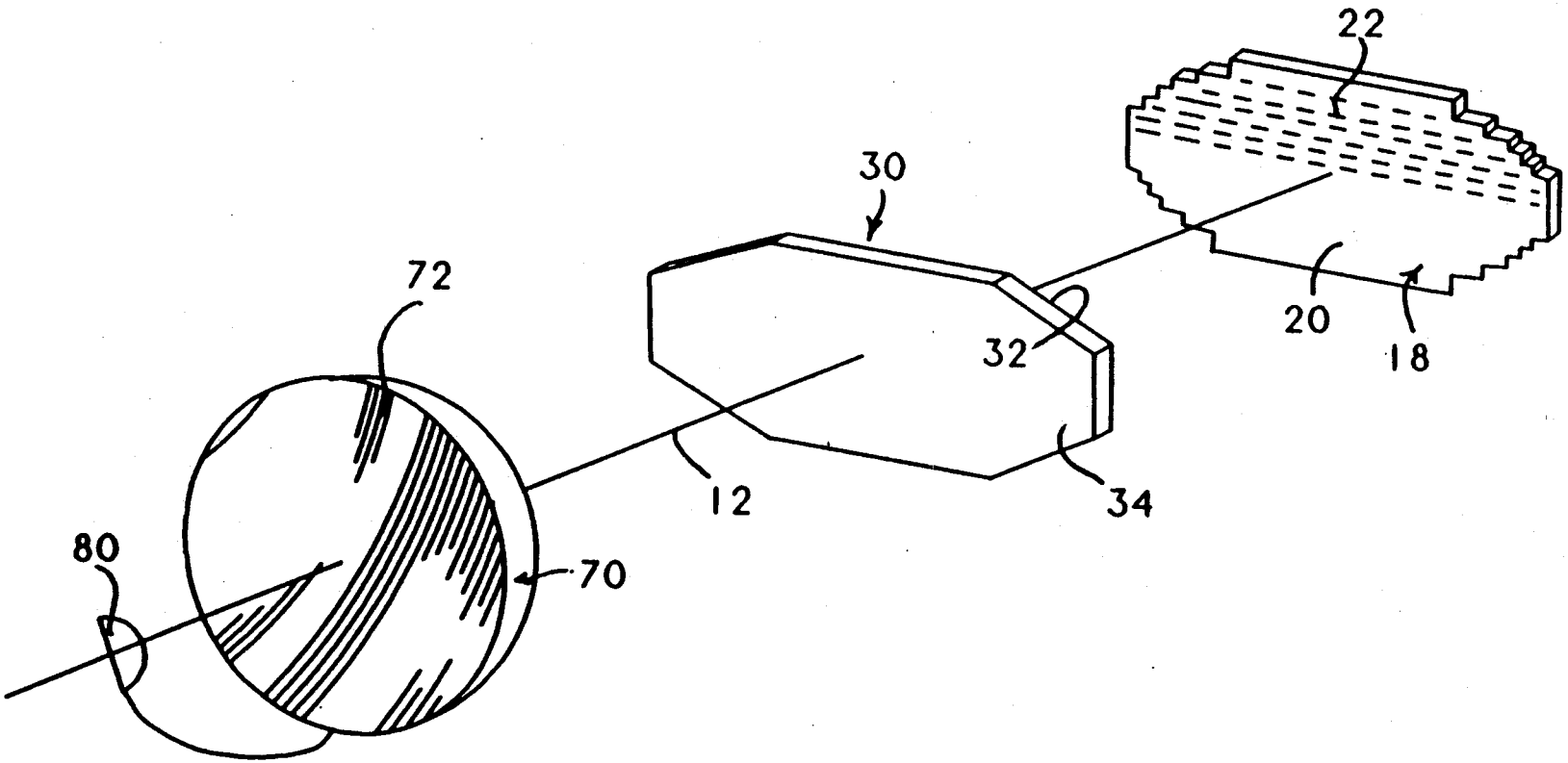
FIG. 3 is an exploded three dimensional view of an antenna system in accordance with the present invention.

Referring to FIGS. 1 and 2, an outline of a radome extending from the nose of an aircraft is referred to at 10. The radome has a longitudinal axis 12 extending in the direction of aircraft travel through the radome aperture 14. An antenna system according to the present invention, generally referred to at 16, is mounted in radome 10 along longitudinal axis 12. In accordance with the present invention, the antenna system comprise a waveguide antenna having an axis corresponding to axis 12, for example, and a radiating and receiving front surface extending in a plane orthogonal to the axis for radiating and receiving RF energy polarized in a predetermined plane. As embodied herein, and referring to FIGS. 1 and 3, a waveguide antenna 18 is preferably a conventional flat plate slotted waveguide planar array antenna polarized in the vertical plane. Antenna 18, which is mounted rearmost in radome 10 has a front planar surface or broad wall 20 extending orthogonal to axis 12. Front surface 20 has a large number of radiators in the form of thin slots 22 cut therein. Antenna 18 radiates electromagnetic energy having linearly polarized fields in a plane perpendicular to the length of slots 22; and effectively receives similarly polarized return energy.

Figure 4:
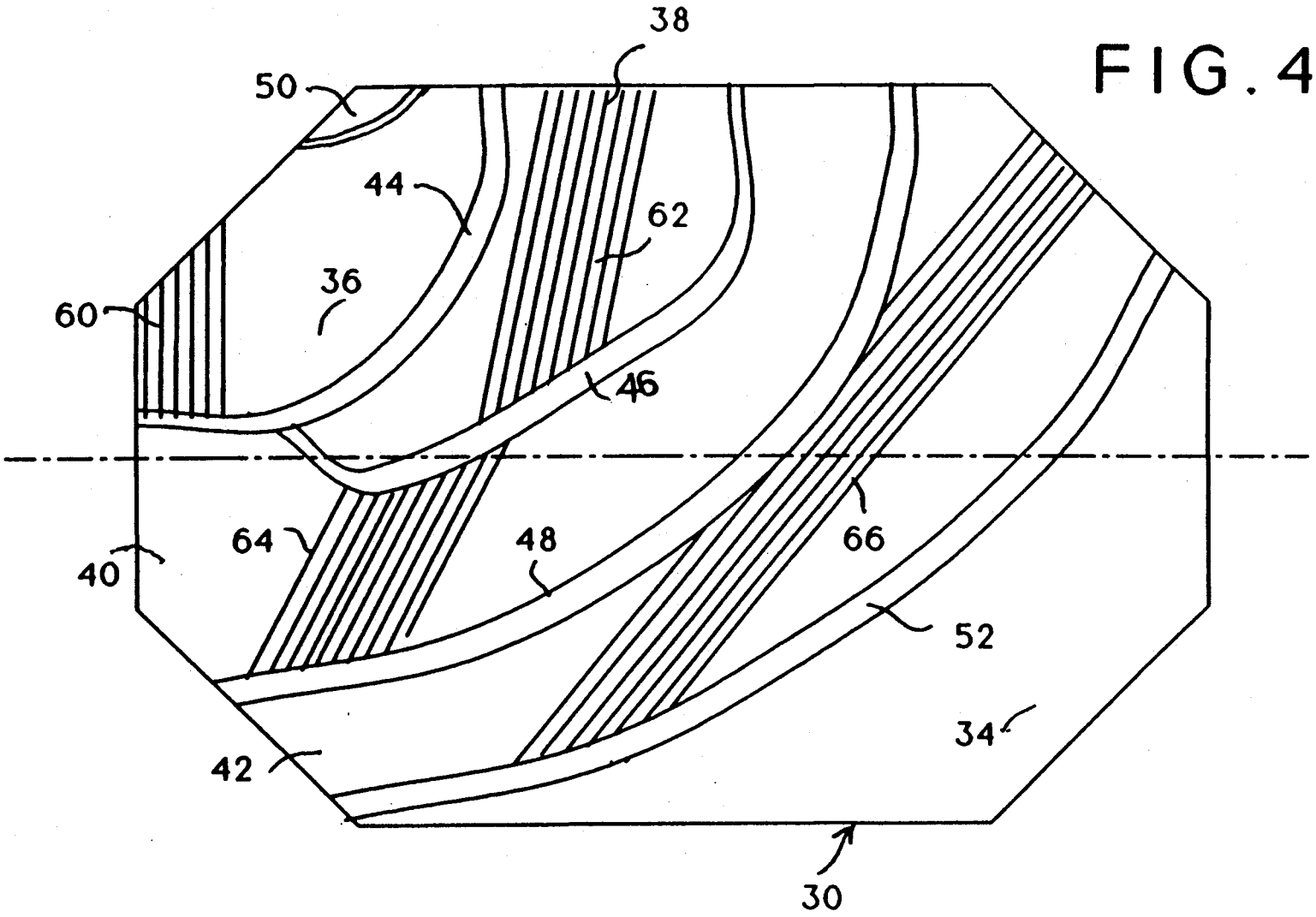
FIG. 4 is a plan view of a twist panel utilized in one preferred embodiment of the present invention with parts broken away to show the individual layers and conductors therein.

In accordance with the present invention, means are disposed along the axis opposing the front surface of the waveguide antenna for twisting the polarized energy radiated from the front surface about the axis a selected number of degrees from the predetermined plane and for twisting the twisted return energy about the axis to an angle approximately corresponding to the predetermined plane. As herein embodied, and referring to the drawings, the twisting means is preferably a panel 30 mounted forward of antenna 18 in radome 10 having a rear planar surface 32 opposing front surface 20 of antenna 18, and extending orthogonal to axis 12; and having a planar front surface 34 extending orthogonal to axis 12 facing in the direction of radome aperture 14, for twisting the polarized field in one direction approximately 45 degrees about axis 12. Panel 30 preferably comprises four axially spaced layers 36, 38, 40, and 42. (FIG. 4). Each of the layers may be a fabric with parallel conducting wires woven into the fabric. The four layers are preferably spaced axially from one another at approximately one quarter wavelength intervals using a light weight foam separator, such as styrofoam, between each layer 36, 38, 40, and 42. The foam separators are referred to at 44, 46, and 48. Outer protective layers of foam material 50 and 52 define rear and front planar surfaces 32 and 34, respectively of panel 30. In the present embodiment, the total thickness of panel 30 is approximately one and one quarter inches.

The panel is so oriented that first layer 36 of the panel, which is closest to antenna 18, has parallel conductors 60 extending at an angle of approximately 82.5 degrees from the plane of polarization of the radiated electromagnetic energy. Second layer 38 has parallel conductors 62 extending at an angle of 67.5 degrees from the predetermined or vertical plane of polarization. Third layer 40 has parallel conductors 64 extending at an angle of 52.5 degrees from the plane of polarization, and fourth layer 42 has parallel conducting wires extending at an angle of 45 degrees from the plane of polarization. In one actual embodiment, the wire conductors of each layer were spaced approximately 0.07 of an inch from one another, and were approximately 0.003 to 0.004 of an inch in diameter. The panel constructed as herein described had less than 0.2 dB of loss and 30 db of polarization isolation.

Figure 5:
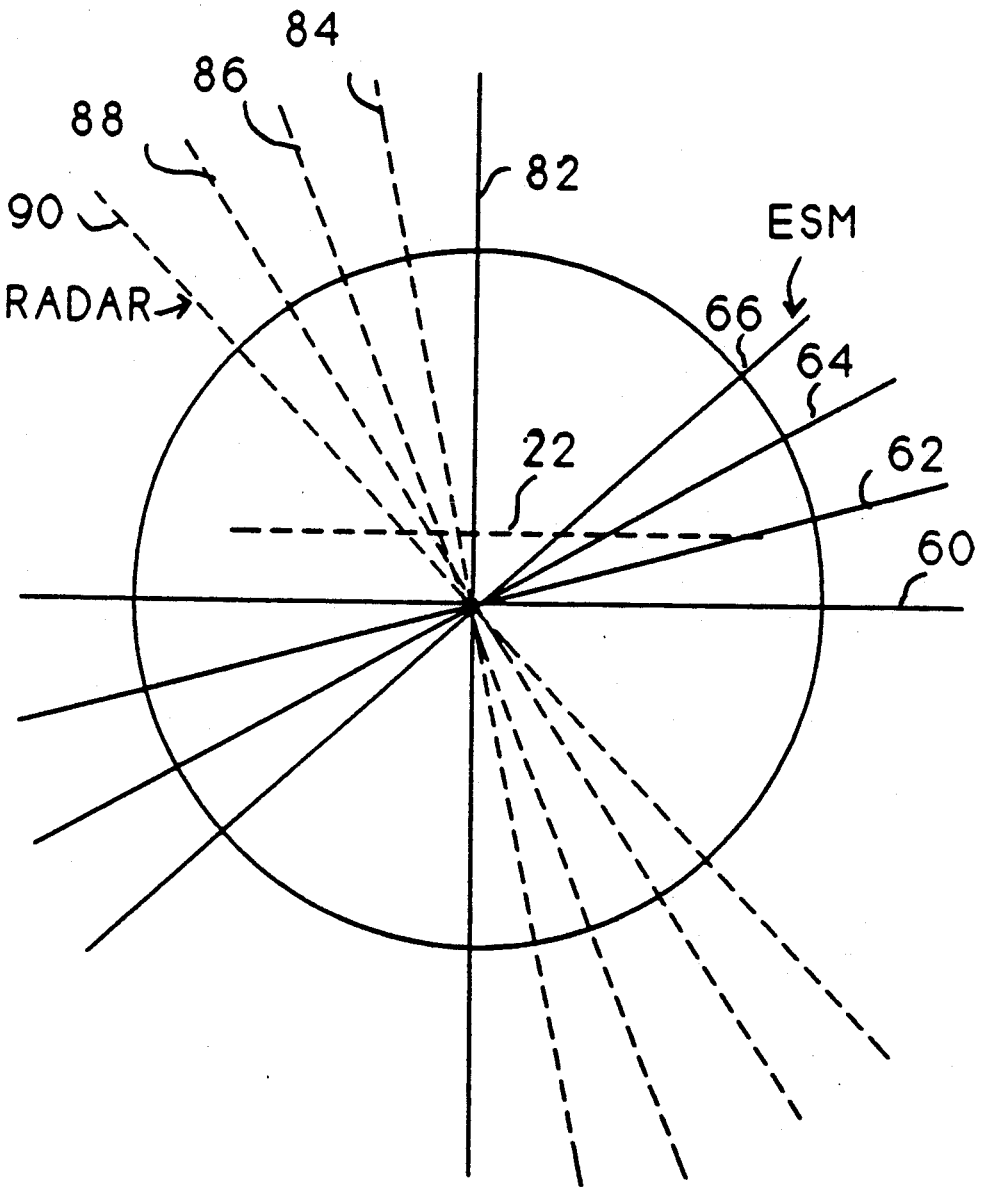
FIG. 5 is a diagramatic view of the polarization of the energy and the orientation of parallel wires in the system.

Referring to FIG. 5, the vertical plane of polarization of the transmitted electromagnetic energy and the return energy reaching antenna 81 is represented by line 82. The plane of polarization of the transmitted electromagnetic energy between layer 36 and layer 38 of panel 30 is represented by dashed line 84 which is perpendicular to parallel conductors 60. Between layers 38 and 40, the plane of polarization is represented by dashed line 86, which is perpendicular to parallel conductors 62 of layer 38. The plane of polarization of the electromagnetic energy between layers 40 and 42, and layers 42 and 44, represented by lines 88 and 90 respectively, which are perpendicular to corresponding parallel conductors 64 and 66. Thus, instead of passing in its energized form or reflecting the radiated vertically polarized electromagnetic energy, it twists it in increments so that it exits the twist panel at an angle of 45° from the vertical polarization; and the return twisted energy enters the flat plate antenna at the radiated angle of polarization.

Although fabric with woven wire conductors are described herein, it is contemplated that panel 30 could be constructed, for example, of dielectric layers with metallic obstacles or conductive strips printed thereon. Whatever particular structure is used, however, its function is to introduce a medium into the electromagnetic ray paths which is polarization sensitive; that is, it should exhibit a difference in the insertion phase between linearly polarized electric fields which are orthogonal in spatial orientation (e.g., vertical and horizontal or crossed slant linear). In order to rotate any linear polarization by an angle Q, such as 45 degrees, the differential phase of the medium must be oriented at an angle of Q/2 with respect to the direction of the electromagnetic field. It also should be made so that a minimum of energy is reflected from the device, essentially an impedance matching function, which is achieved by gradually changing electrical parameters (tapering) or by introducing reactive discontinuities which are spaced so as to cancel the effects of the discontinuities.

In accordance with the invention, discriminating means are disposed along the axis adjacent to the twisting means for passing in opposite directions along the axis electromagnetic energy polarized in the twisted plane, and for reflecting received electromagnetic energy polarized in planes substantially different from the twisted plane. As herein embodied and referring to the drawings, a selective reflector 70 is mounted along axis 12 adjacent to and forward of front surface 34 of panel 30 in the radome. Reflector 70 is preferably a parabolic reflector made of a wire grating 72 from parallel wires or thin metal strips extending in a direction parallel to wires 66 of layer 42 nearest reflector 70 for passing electromagnetic energy perpendicular to the twisted or 45° plane, and reflecting electromagnetic energy polarized in planes substantially different from the twisted plane.

The present invention comprises feed means disposed along the axis opposing the discriminating means for collecting the reflected energy. As herein embodied and referring to FIGS. 1, 2, and 3 a broadband radiator 80 is disposed at or near the focal point of reflector 70 and axis 12. The feed means may be any well known type provided that it is sensitive to linear polarization which is perpendicular to that emerging from twist panel 30.

In operation, the method of radiating RF energy and receiving return energy in combination with receiving ESM signals along the same antenna axis comprises radiating and receiving RF energy polarized in a predetermined plane at an antenna surface along the antenna axis. As implemented herein and referring to FIG. 5, "flat plate" slotted-waveguide planar array radar antenna 18 is vertically polarized relative to horizontal slots 22 as shown by line 82 (see FIG. 5). In accordance with the present invention, the method includes twisting the radiated and return energy about said axis to a selected angle from the predetermined plane. As herein implemented, panel 30 made of four layers 36, 38, 40 and 42 of axially spaced parallel conductors that twist the RF energy in small predetermined increments along the axis. In accordance with the present invention the method includes passing the twisted radiated and return RF energy in opposite directions along the axis through a selective reflector and reflecting electromagnetic energy polarized in planes substantially different from the plane of the twisted return electromagnetic energy.

As implemented herein, parabolic reflector 70 has a grate of either parallel wires or thin metal strips 72 oriented so that they extend at right angles to the polarization of the field after twisting by panel 30, or in other words parallel to wires 66 of panel 30.

The method further includes collecting the reflected electromagnetic energy at a feed location. As herein implemented broadband feeder 80, is disposed near the focal point of reflector 70 as previously described, which may be a low profile tapered notch feed polarized parallel to wires 72 of the reflector. By using 45° slant linear polarization for the ESM function, horizontally polarized energy is effectively received at feeder 80.

It is to be understood that the electromagnetic energy polarized perpendicular to the twisted polarization which is also 45° from the vertical polarization or, in other words parallel to the direction of the parallel conductors 72 of reflector 70, exhibit the strongest reflectivity in striking the parabolic antenna. Since, ESM signals are normally polarized in either the horizontal and vertical planes, such horizontal and vertical plane signals are reflected but with lesser strength than those exactly parallel to the conductors 72 of the reflector. As the ESM signals start to approach polarization between vertical and horizontal in a direction tending perpendicular to the conductors 72, a greater amount of the signal passes through reflector 70 until the entire signal effectively passes through when perpendicular to wires 72 and 66 of panel 30. When the return energy of the radar system is twisted at the same angle of 45 degrees as that transmitted and twisted by panel 30; it is perpendicular to wires 72 and has the greatest transparency to such signals. However, in actual practice, such return polarization may vary between 45° and vertical polarization which will cause a portion of the incoming signal to be reflected as it moves away from polarization perpendicular to wires 72. The radar receiver will of course receive a more attenuated signal as the incoming waveform is polarized at angles that deviate from the twisted polarization. Similarly, less of the ESM signals will be reflected as the polarization approaches the twisted polarization.

The system and method described herein has been determined to twist radar polarization 45 degrees with insignificant loss, and that an orthogonally polarized wire grid reflector has negligible aperture blockage effects on the radar pattern. Also, the method and system of the present invention makes maximum use of the limited aperture available on nose-radome antennas to provide multiple function performance. The ESM or reflector antenna 70, 80 can operate over a wide (octave or more) bandwidth, which includes the radar operating band.

It will be apparent to those skilled in the art that various modifications and variations can be made to the system and method of the present invention without departing from the spirit or scope of the invention. Thus, it is intended that the present invention cover the modifications and variations of the invention provided they come within the scope of the appended claims and their equivalents.

What is claimed is:

1. A combined Radar/ESM antenna system comprising:

a waveguide antenna having an axis and a radiating and receiving front surface extending in a plane orthogonal to the axis for radiating and receiving electromagnetic energy polarized in a predetermined plane;

means disposed along the axis opposing the front surface of the waveguide antenna for twisting the polarized energy radiated from the front surface about the axis a selected number of degrees from the predetermined plane and for twisting the twisted return energy in the opposite direction about the axis to an angle approximately corresponding to the predetermined plane, the twisting means having a first surface opposing the front surface of the waveguide antenna, and a second surface opposing a discriminating means, the radiated electromagnetic energy striking the first surface and exiting through the second surface of the twisting means and the received electromagnetic energy striking the second surface and exiting through the first surface of the twisting means;

said discriminating means disposed along the axis adjacent to the twisting means for passing in opposite directions along the axis electromagnetic energy polarized the selected number of degrees about the axis from the predetermined plane;

means for reflecting received energy polarized in planes substantially different from the twisted plane; and feed means disposed along the axis opposing the discriminating means for collecting the reflected energy.

2. The system of claim 1 wherein the waveguide antenna has a front surface for radiating electromagnetic energy and receiving return electromagnetic energy polarized in the vertical plane.

3. The system of claim 1 wherein the waveguide antenna has a slotted front surface for radiating and receiving the electromagnetic energy.

4. The system of claim 1 wherein the twisting means comprises a panel having a first substantially planar surface opposing the front surface of the waveguide antenna, and a second substantially planar surface opposing the discriminating means.

5. The system of claim 4 wherein the panel of the twisting means comprises a plurality of axially disposed layers;

and each of the layers has a plurality of spaced parallel conductors.

6. The system of claim wherein the plurality of spaced parallel conductors of each layer comprises a plurality of parallel conducting wires, the parallel conducting wires of each layer extending in successively increasing angular directions from the vertical plane for incrementally twisting the radiated and received electromagnetic energy striking the respective first and second planar surface of the panel.

7. The system of claim 6 wherein each of the plurality of layers of conductors lay in a plane axially spaced approximately 0.3 of an inch from one another.

8. The system of claim 5 wherein the plurality of axially spaced layers, comprise a first layer having a plurality of spaced parallel conductive wires extending at an angle approximately 82.5 degrees from vertical plane; a second layer having a plurality of spaced parallel conductive wires extending at an angle of approximately 67.5 degrees from the vertical plane in the same direction as the conductors of the first layer; a third layer having a plurality of spaced conductors extending at an angle of approximately 52.5 degrees from the vertical plane in the same direction as the second layer;

and a fourth layer having a plurality of spaced conductors extending at an angle of approximately 45 degrees from the vertical plane in the same direction as the third layer.

9. The system of claim 5 wherein each of the plurality of layers is a layer of cloth having parallel wires woven therein.

10. The system of claim 5 wherein the corresponding conductors of each layer are disposed approximately 0.07 inches from one another.

11. The system of claim 5 wherein each of the conductors are in the range of approximately 0.003 to 0.004 of an inch in diameter.

12. The system of claim 1 wherein the discriminating means comprises a grid having spaced conductors extending at an angle of approximately 45 degrees relative to the vertical plane.

13. The system of claim 12 wherein the grid is configured in the form of a parabola having a focal point on the axis of the antenna system.

14. A method of radiating electromagnetic energy and receiving return energy in combination with receiving ESM signals along the same antenna axis comprising;

radiating and receiving electromagnetic energy polarized in a predetermined plane at an antenna surface along the axis;

twisting the radiated and return energy about the axis to a selected angle from the predetermined plane, the respective direction of the radiated and return energy along the axis being maintained;

passing the twisted radiated and return RF energy in opposite directions along the axis through a selective reflector; and reflecting electromagnetic energy received along the axis polarized in planes other than the twisted plane; and collecting the reflected electromagnetic energy at a feed location.

15. The method of claim 14 wherein the step of twisting the radiated and reflected electromagnetic energy comprises the substeps of twisting the RF energy in predetermined increments along the axis.

16. The method of claim 15, wherein the substeps of twisting the RF energy, comprise twisting the energy in increments of 82.5 degrees, 76.5 degrees, 37.5 degrees, and 45 degrees from the predetermined plane, respectively.

17. The method of claim 14 wherein the step of passing the twisted electromagnetic energy, includes passing the energy through a wire grid having spaced conductors extending in a direction perpendicular to the twisted plane; and the step of reflecting includes collecting electromagnetic energy polarized in planes substantially different from said twisted plane at said same wire grid.

18. The method of claim 14 where the step of radiating electromagnetic energy and receiving the return energy includes radiating the energy from a waveguide surface having spaced slots for polarizing electromagnetic energy in the vertical plane; and collecting electromagnetic energy polarized in the vertical through the spaced slots.

19. A method of radiating electromagnetic energy and receiving return energy in combination with receiving ESM signals along a longitudinal axis through an aperture of a radome in a nose of an aircraft, comprising;

radiating and receiving electromagnetic energy polarized in a predetermined plane along the axis rearwardly of the radome aperture at an antenna surface extending in a plane orthogonal to the axis;

twisting the radiated and reflected energy about the axis at an angle of approximately forty-five degrees relative the predetermined plane at a location between the antenna surface and the radome aperture, the respective direction of the radiated and reflected energy along the axis being maintained;

passing the twisted radiated and return electromagnetic energy in opposite directions along the axis through a reflector at a location between the twisting location and the aperture of the radome;

reflecting electromagnetic energy polarized in planes substantially different from the twisted plane between the twisting location and aperture of the radome; and collecting the polarized reflected electromagnetic energy at a feed location between the passing and reflecting location and the radome aperture.

20. A combined Radar/ESM antenna system mounted in a radome of an aircraft nose having a longitudinal axis extending through the nose, comprising:

a waveguide antenna mounted in the radome and having an axis substantially parallel with the radome axis and a radiating and receiving front surface extending in a plane orthogonal to the waveguide axis for radiating and receiving electromagnetic energy polarized in a predetermined plane;

means disposed along the waveguide axis opposing the front surface of the waveguide antenna for twisting the polarized energy radiated from the front surface about the waveguide axis to an angle approximately 45 degrees from the predetermined plane and for twisting the twisted return energy in the opposite direction about the waveguide axis to an angle corresponding to the predetermined plane, the twisting means having a first surface opposing the front surface of the waveguide antenna, and a second surface opposing a discriminating means, the radiated electromagnetic energy striking the first surface and exiting through the second surface of the twisting means and the received electromagnetic energy striking the second surface and exiting through the first surface of the twisting means;

said discriminating means disposed along the axis between the twisting means and the radome nose for passing in opposite directions energy polarized in the twisted plane, and for reflecting received energy polarized about the waveguide axis perpendicular to the twisted plane; and feed means between the discriminating means and the nose of the radome for collecting the reflected energy.

* * * * *